United States Patent [19]

Bray

[11] Patent Number: 4,557,284

[45] Date of Patent: Dec. 10, 1985

[54] AIRCRAFT HANGER

[76] Inventor: W. Randall Bray, P.O. Box 331, Wilmington, N.C. 28402

[21] Appl. No.: 671,097

[22] Filed: Nov. 13, 1984

[51] Int. Cl.[4] ..... E04B 1/347

[52] U.S. Cl. ..... 135/115; 135/101; 135/97

[58] Field of Search ..... 135/90, 114, 115, 900, 135/105, 119, 97; 52/83, 63

[56] References Cited

U.S. PATENT DOCUMENTS

| | | | |
|---|---|---|---|
| 2,511,974 | 6/1950 | Finken et al. | 135/97 |
| 2,880,741 | 4/1959 | McGrand | 135/97 |
| 2,928,360 | 3/1960 | Heine, Jr. | 135/101 |
| 3,234,695 | 2/1966 | Johnson | 135/97 |
| 3,374,797 | 3/1968 | Neumark | 135/119 |
| 3,383,814 | 5/1968 | Rowe | 52/83 |
| 3,601,944 | 8/1971 | Shepherd | 135/97 |
| 4,008,730 | 2/1977 | Keklak et al. | 135/97 |

*Primary Examiner*—Robert A. Hafer
*Assistant Examiner*—Daniel Nolan
*Attorney, Agent, or Firm*—B. B. Olive

[57] ABSTRACT

An aircraft hanger structure utilizes a flexible membrane fabric as the aircraft cover and a pylon and boom arrangement which connects to and supports the fabric in a double curvature configuration. The structure adapts to contiguous parking areas of different aircraft or for closely parking aircraft of the same or different configuration.

5 Claims, 18 Drawing Figures fig. 14
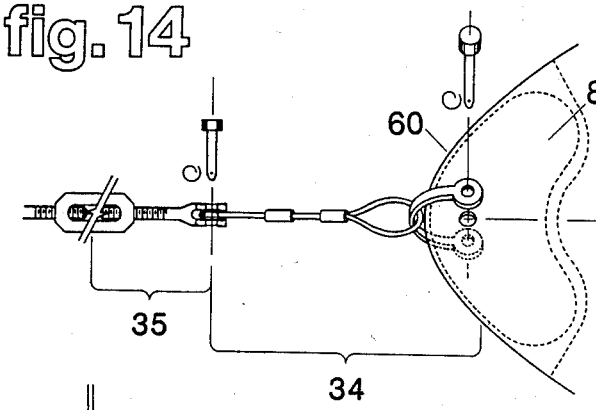
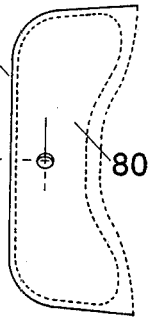
fig. 15
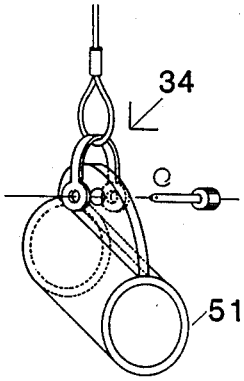
fig. 17
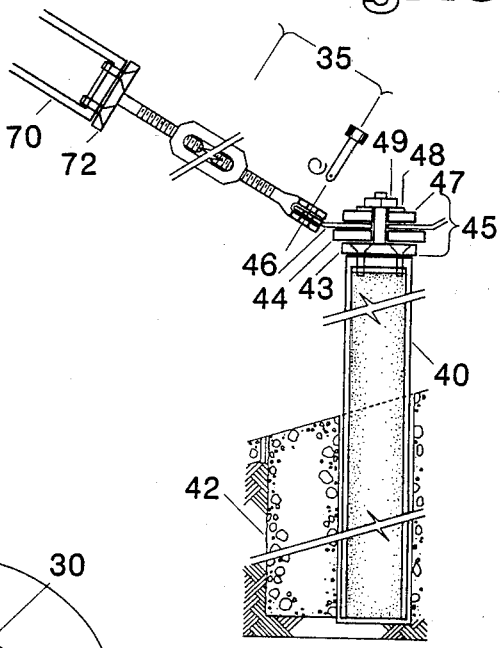
fig. 10
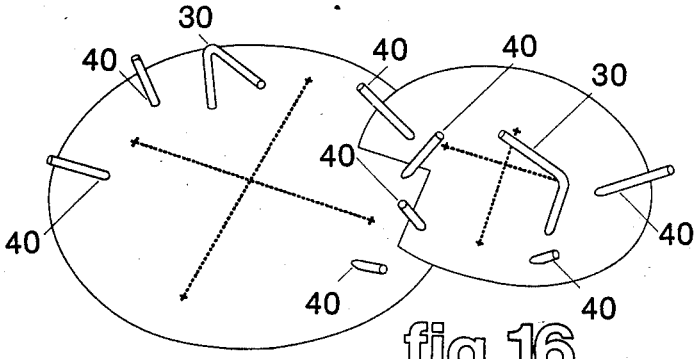
fig. 16
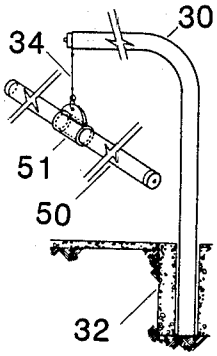
fig. 9
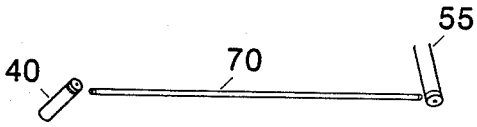
fig. 13

AIRCRAFT HANGER

DESCRIPTION

1. Technical Field

The invention relates broadly to shelter structures but more specifically to aircraft hanger structures adapted for suspending a fabric membrane as an aircraft cover.

2. Background Art

Structure for suspending a fabric as a cover over free ground space on which an aircraft is parked is known. U.S. Pat. No. 4,008,730 illustrates one such structure in which a cable and post-supported frame supports fabric as an aircraft cover. U.S. Pat. Nos. 2,511,974 and 2,880,741 represent other types of post-cable supported fabric covers for aircraft hangers. Numerous other prior art patents could be cited as teaching various types of frames and post arrangements for supporting fabric as an aircraft shelter. However, those patents specifically cited and described are believed to be representative of the prior art sufficient to understand the present invention in the context of the prior art.

With consideration for the aforementioned prior art practices, the prior art has not provided a free standing-type of post-frame fabric membrane support structure adapted to a multiplicity of types of aircrafts, e.g., low wing, high wing, single engine, multi-engine and reciprocating or jet-type aircraft as well as small and large aircraft. More specifically, the prior art aircraft hanger structures do not adapt to selective individual or multiple use within restricted areas so as to make airport parking space utilization efficient as with the present invention.

The present invention thus has as its primary object that of providing an improved post-frame fabric membrane support structure which is adaptable to a variety of types and sizes of aircraft, is specifically adapted to a variety of weather conditions, sun, wind and the like and adapts to individual or multiple use within defined minimum parking areas and utilizes a system of double curvature for structural integrity. These and other objects will become apparent as the description proceeds.

DISCLOSURE OF INVENTION

The aircraft cover structure of the invention comprises a plurality of vertical supporting pylons which are secured in the ground area and extend upwardly and outwardly from the parking area in which the aircraft is to be parked. One of the pylons terminates in a substantially horizontal elevated end portion overlying the parking area. Two of the pylons support a tether which in turn supports one end of an elongated boom. An intermediate portion of the boom is supported by the overlying pylon and a cantilevered end of the boom points in the opposite direction of the tethered end. A fabric membrane cover is supported by all of the pylons and the boom in a manner in which certain of the pylons are treated as anchor pylons and are adapted to hold the fabric down and an overlying pylon and boom are adapted to hold the fabric up and outward to place the synthetic fabric membrane in tension and to create a structural double curvature of the fabric surface.

BRIEF DESCRIPTION OF DRAWINGS

FIG. 9 is a side elevation view of an overlying pylon element employed in the invention.

FIG. 10 is an enlarged fragmentary elevation view, partially sectioned, of the anchor pylon element employed in the invention.

FIG. 13 is a perspective view of a tether element employed in the invention.

FIG. 14 is a plan view of a former element employed in the invention.

FIG. 15 is a top plan view of an alternative embodiment of a former element employed in the invention.

FIG. 16 illustrates a pair of intermeshed parking pads with allowance for different type aircraft parked which area is indicated by an "X" made with heavy dashed lines on each pad illustrating how the invention system minimizes parking area.

FIG. 17 is a perspective view of a boom support.

BEST MODE FOR CARRYING OUT THE INVENTION

Figure 11:
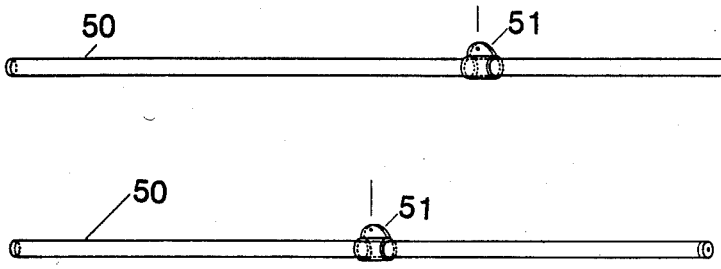
FIG. 11 is a perspective view of a boom employed in the invention.
Figure 12:
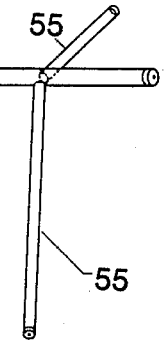
FIG. 12 is a perspective view of a modified boom employed in the invention.
Figure 18:
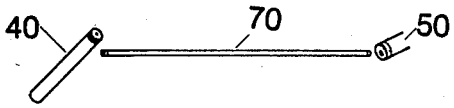
FIG. 18 is a perspective view of a modified boom connecting to a pylon.

As will become apparent from the description to follow, the invention hanger utilizes a system of basic components which accommodate in different arrangements to provide a useful and unique cover for a wide variety of aircraft as exemplified in the drawings. The basic components included in such system include an overlying pylon 30, detailed in FIG. 9; an anchor pylon 40, detailed in FIG. 10; a boom 50, detailed in FIG. 11; and with boom extensions 55, detailed in FIG. 12; tether elements 70, detailed in FIG. 13; and former elements 80, detailed in FIG. 14. Thus, by using any of the mentioned elements in suitable configurations, the invention hanger generally designated 20 in FIGS. 1–8 for reference adapts to a wide variety of aircraft including those shown as well as other types such as the canard-type aircraft, not shown, which typically has a small wing in front and a large wing towards the rear of the aircraft.

The overlying pylon 30 is firmly secured at the parking surface by means of concrete 32 (see FIG. 9), or the like, and having at its outer extremity a cable eye and bolt 33, or the like, for supporting the boom 50 by means of a hook/sleeve 51 located substantially midway of the length of boom 50. The overlying pylon is located relative to the aircrafts planar geometry so as to provide clearance for its access/egress as shown, for example, in FIGS. 1 and 2.

In operative association with the single overlying pylon element 30 employed in the invention there are a plurality of anchor pylon elements 40 which are firmly secured by concrete 42, or the like, as best seen in FIG. 10. FIG. 10 illustrates a closed end aluminum tube 40 with one end imbedded in sufficient concrete 42 and the other free end bolted to an aluminum assembly 45 composed of a plate cap end and an upstanding threaded stud 43 connected to element 40; an aluminum washer 44; an aluminum flat plate connector 46; which in turn allows connection to the metal turnbuckle plus pin connection assembly 35. As part of the mentioned assembly 45; an aluminum washer 47 and a metal lock washer 48 plus a metal threaded nut 49 are connected to the upstanding threaded stud 43. Item 72 is composed of a plate cap end and an upstanding threaded stud (similar to item 43 above) in turn connected to the metal turnbuckle of assembly 35; which is attached at each end of element 70. Element 70 is a closed end aluminum tube.

Since a turnbuckle-type connection such as seen in FIG. 10 and designated 35 is used in many places in the invention construction, the numeral 35 is used throughout the drawings to designate this type connection. Also, since a cable, cable eye and bolt-type connection such as seen in FIG. 14 is also used in many places in the invention construction, the numeral 34 is used to generally designate this type connection.

Figure 1:
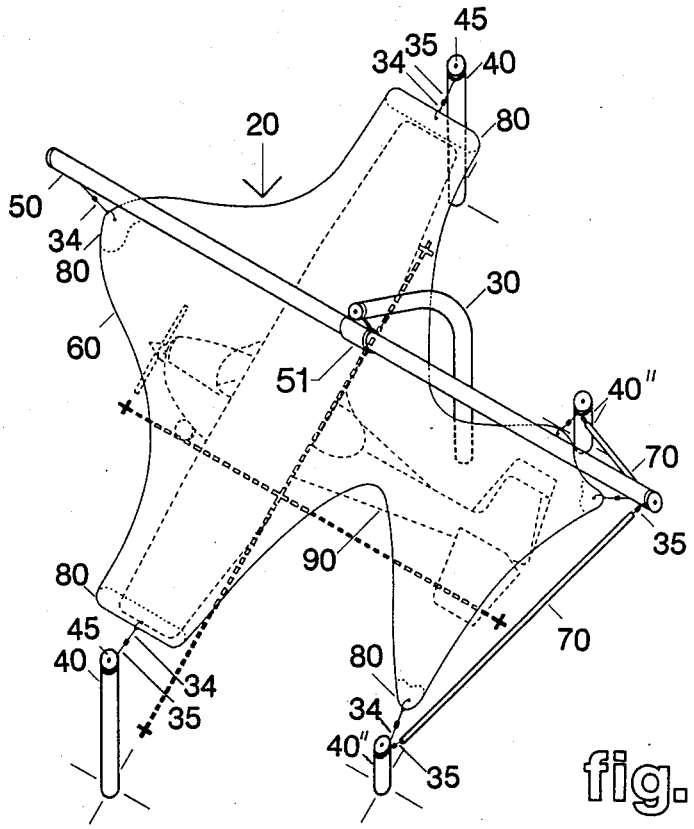
FIG. 1 is a perspective view of an aircraft hanger according to the invention illustrating by way of example storage of a small-type aircraft, shown in dashed lines, with a high wing and low tail/horizontal stabilizer and showing by an X line the parking area.
Figure 8:
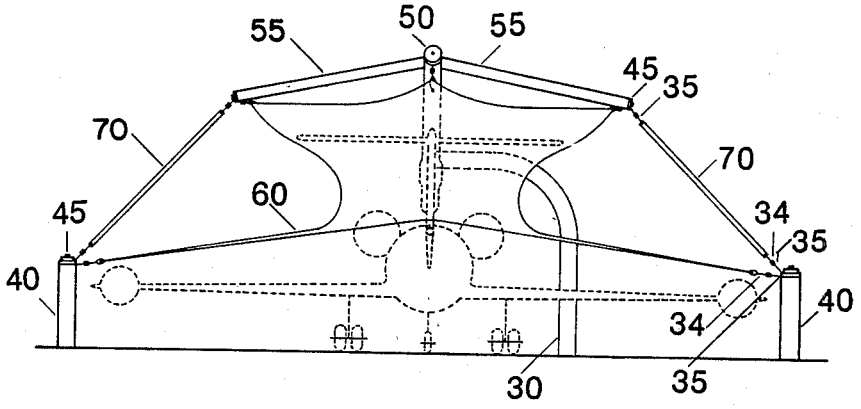
FIG. 8 is a rear elevation view of the aircraft hanger of FIGS. 2, 4 and 6 covering a typical large-type aircraft, shown in dashed lines.
Figure 2:
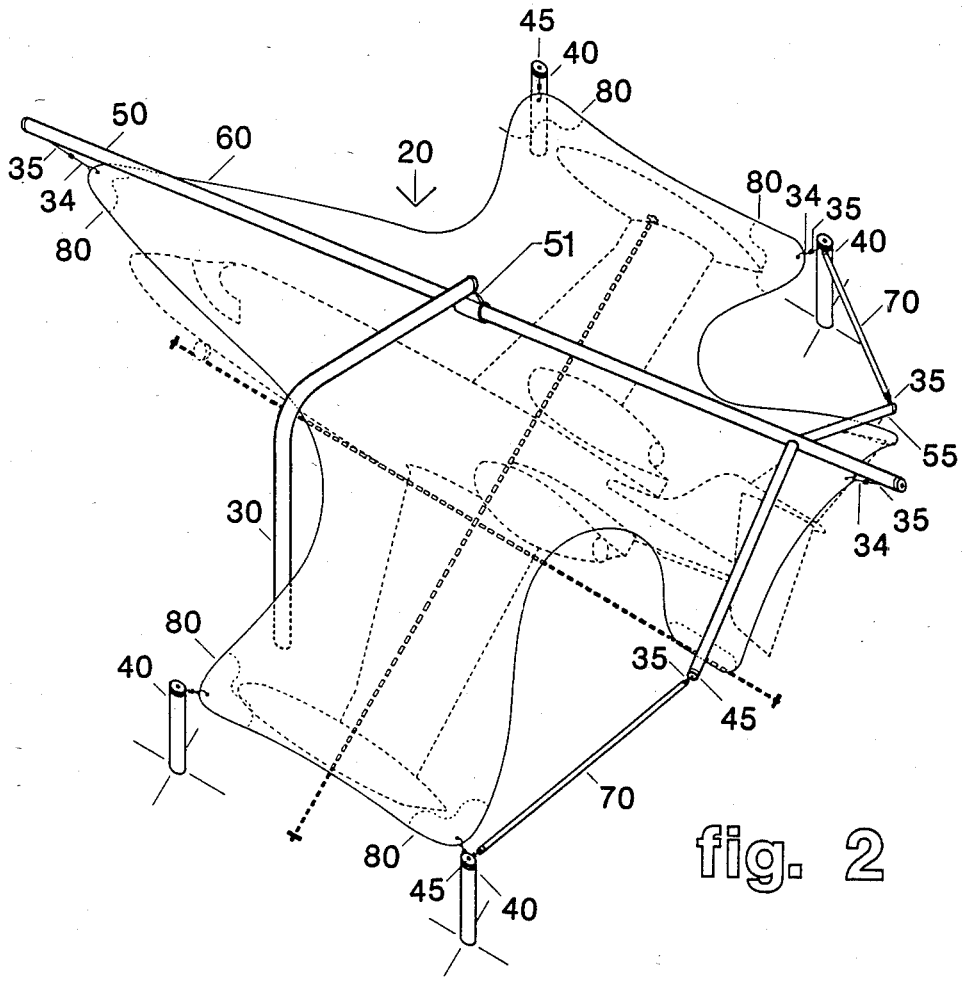
FIG. 2 is a perspective view illustrating the invention aircraft hanger covering a large-type aircraft, shown in dashed lines, with a low wing and high tail/horizontal stabilizer and by an X line the parking area.
Figure 7:
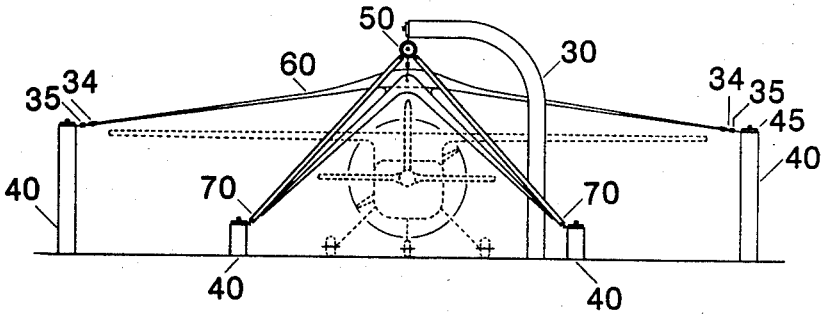
FIG. 7 is a rear elevation view of the invention aircraft hanger of FIGS. 1, 3 and 5 covering a typical small-type aircraft, shown in dashed lines.
Figure 5:
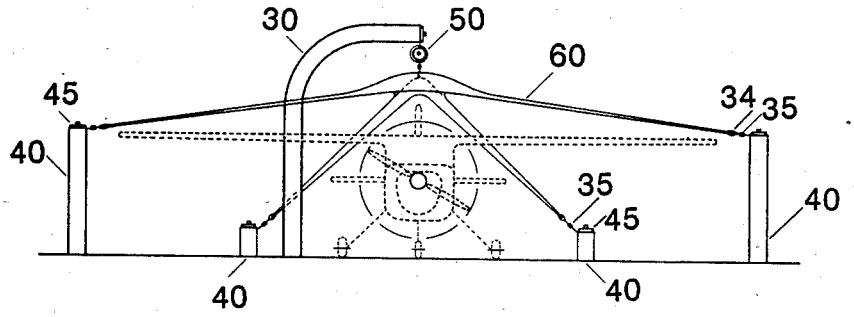
FIG. 5 is a front elevation view of the invention aircraft hanger of FIGS. 1 and 3 covering a typical small-type aircraft, shown in dashed lines.
Figure 3:
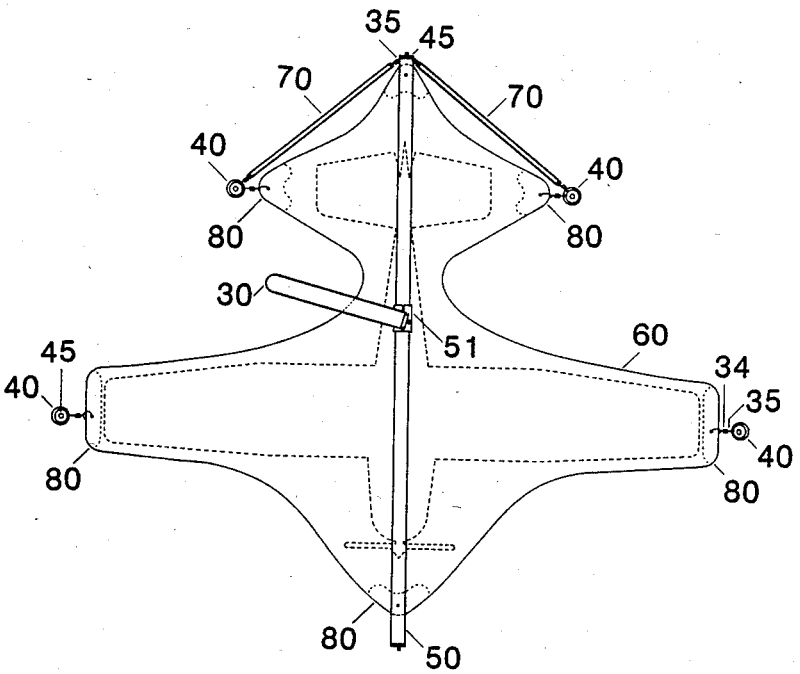
FIG. 3 is a top plan view of FIG. 1 illustrating the invention aircraft hanger covering a typical small-type aircraft, shown in dashed lines.
Figure 6:
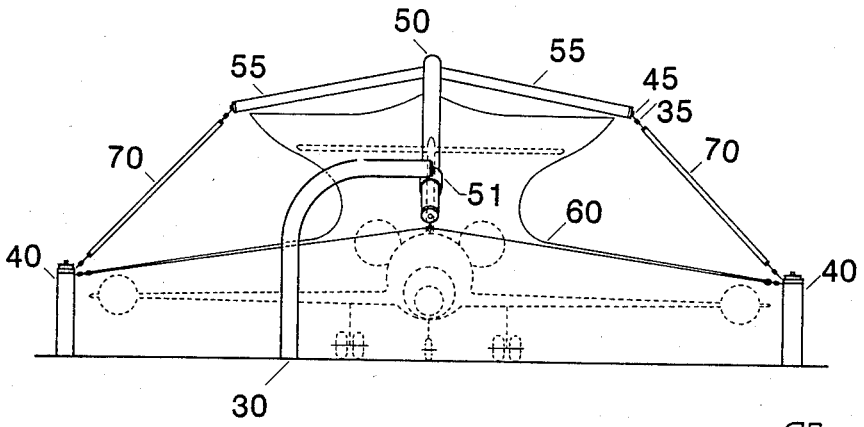
FIG. 6 is a front elevation view of the invention aircraft hanger of FIGS. 2 and 4 covering a typical large-type aircraft, shown in dashed lines.
Figure 4:
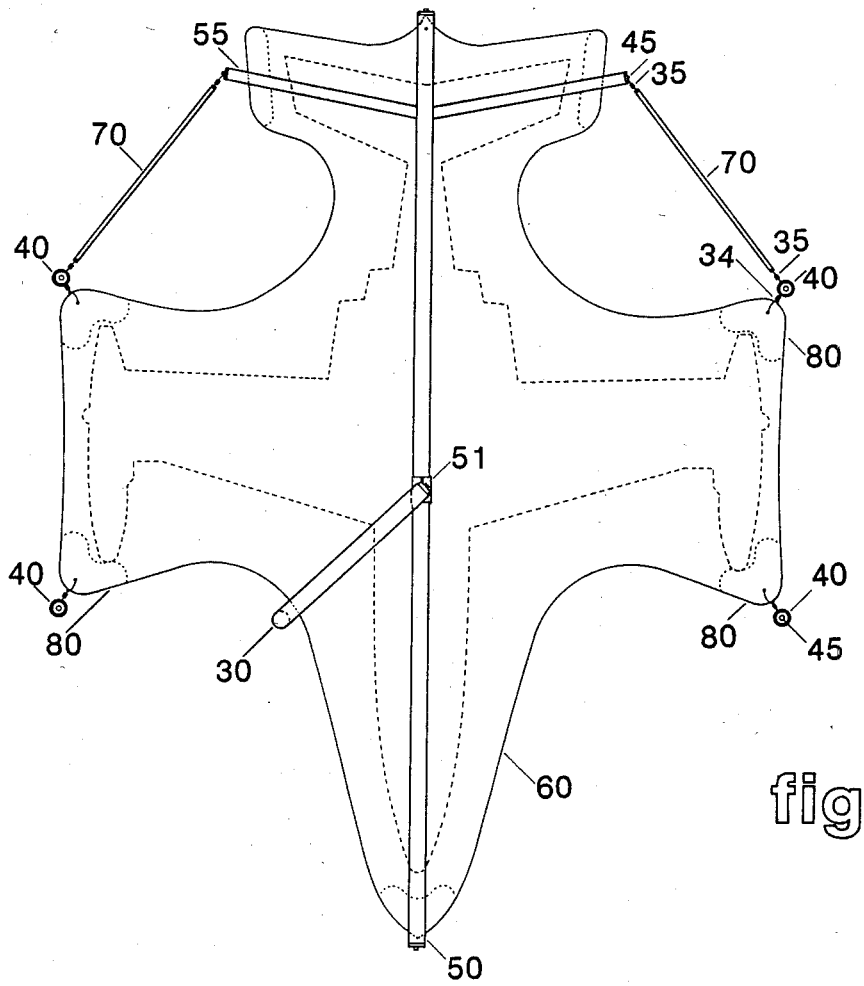
FIG. 4 is a top plan view of FIG. 2 illustrating the invention aircraft hanger covering a typical large-type aircraft, shown in dashed lines.

In FIG. 1, for example, four anchor pylons 40 are employed for the aircraft hanger 20 of the invention when used to cover the illustrated small-type aircraft 90 shown in dashed lines. The anchor pylons 40 are also located relative to the aircraft's geometry to provide clearance for its access and egress as further illustrated, for example, in FIGS. 3 and 4.

The boom element 50 extends substantially parallel to the longitudinal axis of the aircraft in an elevated position over the aircraft and essentially parallel to the path of egress of the aircraft. As previously mentioned, the boom element 50 is supported by the overlying pylon element 30 at approximately the midpoint with some variation depending on the aircraft. In FIG. 9, the overlying pylon (a closed end aluminum tube) element 30 free end connects by a cable and cable eye and bolt 34 to a sleeve element 51. The sleeve element 51, seen in FIG. 17, fits loosely on boom 50 and allows movement and adaptability of the boom 50 support to varying wind conditions as well as location of element 51 along the boom 50 for varying centers of gravity derived from different aircraft configurations. The ability of the system to easily adjust to varying centers of gravity is important because all of the upward force generated by the sleeve 51 and the boom 50 when acted upon by wind and the like are in turn resisted by the anchor elements 40. Such resistive forces are generally equal at the anchor elements if the upward force is generated through the system's general centroid. The overlying pylon element 30 allows adjustment to the point of support at the boom 50; and the sleeve 51 allows support adjustment along the boom 50 all of which are required to provide support at the centroid of various cover configurations of different aircraft and consequently different wind loadings. The sleeve 51 allows a means of adjustment along the boom element 50 to provide for aircraft of varying lengths and wing span configurations and which in turn require different fabric membrane element 60. The described invention configuration is such that when acted upon under various wind conditions unnecessary concentration of stress at any one of the anchor pylon elements 40 is avoided. The overlying pylon element 30 supports boom element 50 which comprises a closed end aluminum hollow tube capped at each end. Each end of boom element 50 mounts a turnbuckle connection 35 and a cable, cable eye, bolt connect 34 for connecting to openings in an assembly like element 45 and in turn connects to openings in the fabric membrane element 60 and former element 80 which in turn support and stretch, i.e., post tension, the fabric membrane element 60 along its longitudinal axis which is parallel to the aircraft's path of egress.

Supporting and post tensioning the fabric element 60 in the manner indicated causes a curve in the shape and general area of the fabric which falls between the two ends of the boom element 50. The two high points of the curve naturally are near the boom 50 ends where the fabric 60 is immediately supported. The low point of the fabric 60 curve will generally be toward the middle since the fabric 60 is unsupported in the middle. An examination of the fabric 60 on a line drawn between anchor pylons 40 on opposites sides of the aircraft will indicate a curved line similar to the above curved line but opposite in the following manner: the ends of the fabric membrane element 60 attached at the anchor pylons 40 will be the low point of the curve since the fabric 60 is being held down at this point while the high point of the curve will tend to be in the middle of the fabric membrane element 60, since it is generally unrestrained at this point. Thus, with a common surface as we have above the fabric element 60 being supported at its extremities with some upward force and at other points by equal and downward forces in turn generates a surface of double curvature. The structural integrity and advantages of double curved surfaces is well known to those skilled in the art.

The fabric membrane element 60 should preferably be highly flexible, resistant to weather conditions, substantially strong and adapted to ease of fabrication. Various reinforced, synthetic fabrics are currently found to be ideally suited for this purpose and the availability of such fabrics is well known to those skilled in the art.

The tether element 70 comprises a rigid, tubular member and may be used in one of either of two configurations. As illustrated in FIG. 1, the tether element 70 extends between boom 50 and anchor pylons 40'', 40''. In an alternative configuration, seen in FIG. 2, the tether elements 70 connect to boom extension elements 55 which act to support and place a portion of the fabric membrane element 60 in tension. Boom extensions 55, like tether elements 70, are formed of rigid metal tubing. The boom elements 55 are weld connected to the boom member 50 at one end and have an adjustable type of fixed connection such as a turnbuckle and bolt arrangement 35 at the free end. The drawings show the detail in FIG. 10. The tether elements 70 and boom extension elements 55 are connected to each other and to other members of the system by the type of turnbuckle and bolt connection 35 shown in FIG. 10.

The final component of the invention hanger 20 comprises a former element 80, two of which are shown in use in FIG. 1 at connect points of the fabric membrane 60 and are used to distribute the stress and also to shape the fabric membrane 60 at the points of connection. The former is made of sheet rigid aluminum plate, and each former fits into a pre-formed slot on the underside of the fabric membrane in the manner of a sail batten, see FIG. 14.

In summary, it can be appreciated that the present invention provides an extremely versatile aircraft hanger suited for essentially any type aircraft, large or small, having a fuselage and using high wing or low wing, conventional wing or swept wing, single or multi-engine. The system geometry of the invention also is especially advantageous in allowing aircraft to be parked and covered in a minimum amount of parking area. Thus, there is provided a covered space system utilizing minimum individual aircraft parking space or a minimum of combined parking spaces when used to cover any multiple of aircraft in a contiguous area. So far as applicant is aware, the invention system adapts to any known aircraft configuration and also offers the advantage of being adapted to an essentially portable form of construction.

What is claimed is:

1. An aircraft cover structure for covering an aircraft having fuselage and appended outwardly extending wing structure while parked in a defined area on a parking surface, comprising:

(a) a plurality of vertical-supporting, ground-anchored pylons extending upwardly from the parking surface, outwardly from the parking area in which the aircraft is parked and with at least one of such pylons having an outer-elevated, horizontally-positioned end overlying the parking area;

(b) an elongated tubular boom having one pylon-supported end supported by and secured to tethers which in turn are secured to and supported by upper ends of an opposed pair of said pylons, an intermediate connection substantially at the midpoint of the boom supported by said overlying pylon and an opposite cantilevered end pointed in the direction of aircraft egress and aligned with the longitudinal axis of the aircraft fuselage during parking; and (c) a fabric cover supported by all of the pylons and the boom in a manner in which certain of the pylons treated as anchor pylons are adapted to hold the fabric down and said overlying pylon and boom are adapted to hold the fabric up and to create a structural double curvature of the fabric surface and to place the fabric in tension.

2. An aircraft cover structure as claimed in claim 1 wherein said intermediate connection is adjustable to conform to the centroidal lift center of the aircraft cover of various aircraft types.

3. An aircraft cover structure as claimed in claim 1 wherein said boom has a pair of rigid, outwardly-extending, tubular elements secured to said pylon supported end and said tethers comprise rigid tubular tethers connected between outer ends of said tether elements and said opposed pair of pylons.

4. An aircraft parking and covering system, comprising:

(a) a plurality of defined contiguous parking areas; and (b) for each defined parking area an aircraft cover structure for covering an aircraft having fuselage and appended outwardly extending wing structure while parked in a defined area on a parking surface, comprising:

(i) a plurality of vertical-supporting, ground-anchored pylons extending upwardly from the parking surface, outwardly from the parking area in which the aircraft is parked and with at least one of such pylons having an outer-elevated, horizontally positioned end overlying the parking area;

(ii) an elongated tubular boom having one pylon-supported end supported by and secured to tethers which in turn are secured to and supported by upper ends of an opposed pair of said pylons, an intermediate connection substantially at the midpoint of the boom supported by said overlying pylon and an opposite cantilevered end pointed in the direction of aircraft egress and aligned with the longitudinal axis of the aircraft fuselage during parking; and (iii) a fabric cover supported by all of the pylons and the boom in a manner in which certain of the pylons treated as anchor pylons are adapted to hold the fabric down and said overlying pylon and boom are adapted to hold the fabric up and to create a structural double curvature of the fabric surface and to place the fabric in tension.

5. An aircraft parking and cover system as claimed in claim 4 wherein said parking areas are configured for aircraft of different configurations.

* * * * *